United States Patent [19]

Katz

[11] Patent Number: 4,682,701

[45] Date of Patent: Jul. 28, 1987

[54] TAMPER-PROOF CONTAINER

[76] Inventor: Gary P. Katz, 10 Stockton Rd., Silver Spring, Md. 20901

[21] Appl. No.: 871,849

[22] Filed: Jun. 9, 1986

[51] Int. Cl.[4] ..... B65D 41/50

[52] U.S. Cl. ..... 215/230; 215/232; 215/250; 215/274

[58] Field of Search ..... 215/230, 250, 232, 274

[56] References Cited

U.S. PATENT DOCUMENTS

| | | | |
|---|---|---|---|
| 594,274 | 11/1897 | O'Donnell . | |
| 1,103,737 | 7/1914 | Budlong | 215/232 |
| 2,131,774 | 10/1938 | Waring | 215/250 |
| 3,892,327 | 7/1975 | Leitz | 215/250 X |

FOREIGN PATENT DOCUMENTS 1445902 8/1976 United Kingdom .

*Primary Examiner*—Donald F. Norton
*Attorney, Agent, or Firm*—Donald A. Kettlestrings

[57] ABSTRACT

A tamper-proof container defining a plurality of separate openings around the open mouth area of the container and provided with a metal foil sheet extending across the mouth area and glued to the upper edge portion of the container. A ring member defines a plurality of barb-shaped prongs which penetrate the metal foil and which extend through the openings so that the ring member is tightly held into position against the foil.

21 Claims, 14 Drawing Figures

TAMPER-PROOF CONTAINER

This invention relates to tamper-proof containers and more particularly to such a container wherein tampering with the container will cause visible material damage.

It is important in the packaging of food and medicines to provide containers which are tamper-proof. Various types of tamper-proof containers have been developed over the years, but they have not proved entirely satisfactory under all conditions of service.

It is, therefore, an object of the present invention to provide a tamper-proof container.

Another object is to provide such a container in which tampering causes irreparable visible material damage to the container.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a tamper-proof container, comprising: a bottom wall; at least one sidewall defining an outer surface and projecting upwardly from the bottom wall to form an upper edge; a first annular ring member integral with the upper edge of the sidewall and defining an open mouth area of the container, the first ring member further defining an upper flat annular surface contiguous with the open mouth area, a lower annular surface and a plurality of openings extending between the upper and lower annular surfaces; a thin tearable sheet member located across the open mouth area and positioned onto the upper annular surface; a second annular ring member defining a plurality of barb-shaped prongs, the second ring member positioned against the sheet on the upper annular surface with the prongs projecting through the sheet and the openings to grippingly engage the lower annular surface; and means in operative relationship with the sidewall for removably capping the open mouth area.

In accordance with the invention, the sheet member is preferably comprised of metal foil or plastic which is glued to the upper annular surface. Preferably, the second ring member is substantially L-shaped in cross-section and includes a flange projecting downwardly and adjacent to the sidewall outer surface from a position adjacent to the upper annular surface. In accordance with the invention, each of the prongs are of predetermined length for enabling the prongs to tightly hold the second ring member against the sheet member by the prong barbs engaging the lower annular surface.

It is to be understood that both the foregoing general description and the following detailed description are exemplary and explanatory but are not restrictive of the invention.

The accompanying drawings, which are incorporated in and constitute a part of this specification, illustrate examples of preferred embodiments of the invention and, together with the description, serve to explain the principles of the invention.

Figure 1:
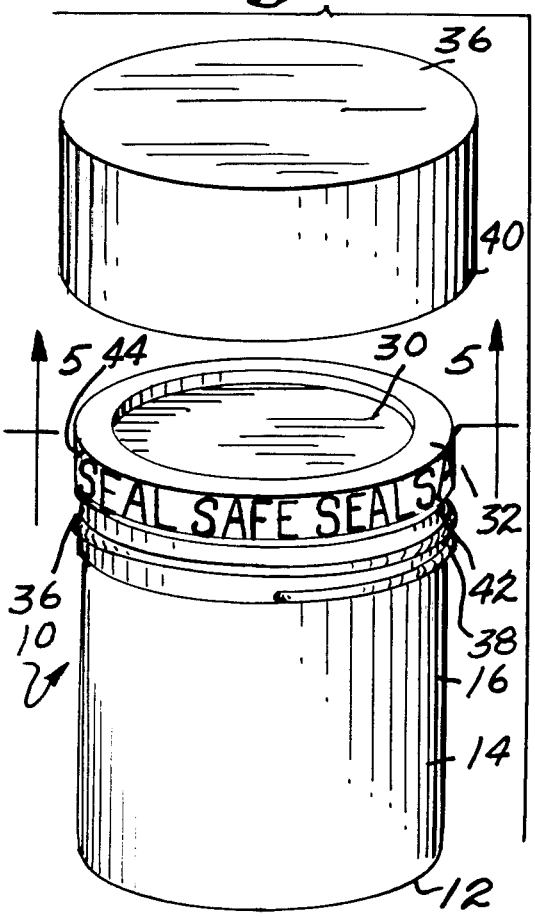
FIG. 1 is a perspective view of one embodiment of this invention showing the cap removed from the container.
Figure 2:
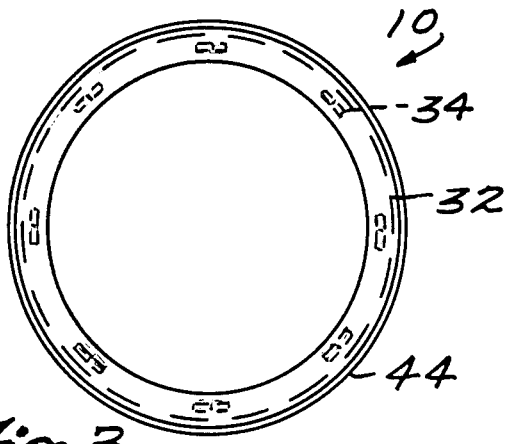
FIG. 2 is a top plan view of the container shown in FIG. 1 with the cap removed.
Figure 3:
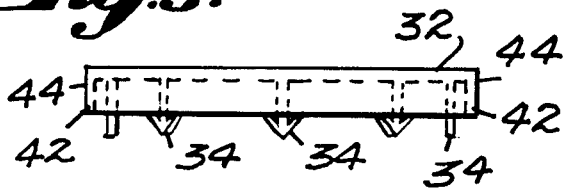
FIG. 3 is a side elevation view of the second annular ring member, as later described, which forms a part of the container shown in FIG. 1.
Figure 4:
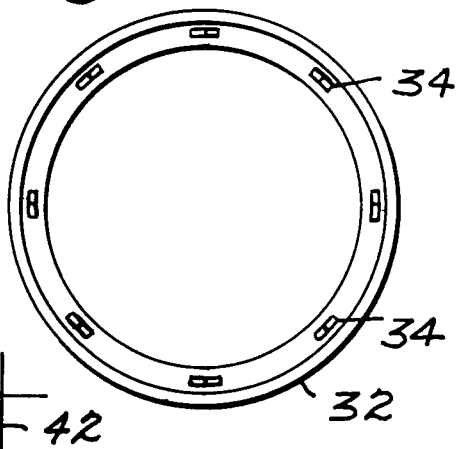
FIG. 4 is a bottom plan view of the ring member shown in FIG. 3.
Figure 5:
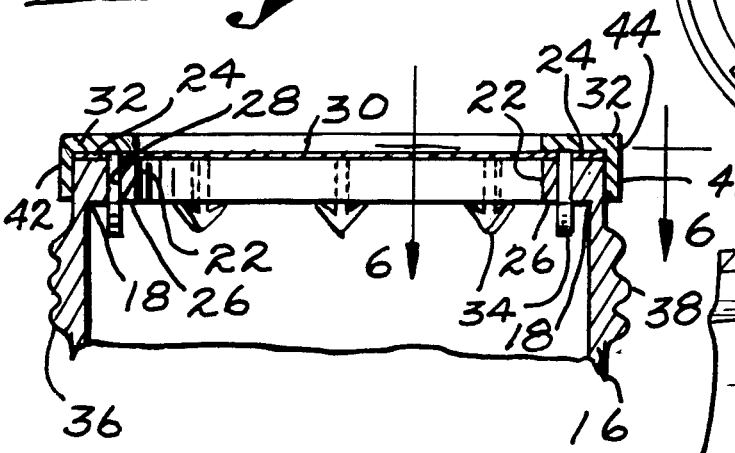
FIG. 5 is a fragmentary cross-sectional view of the tamper-proof container embodiment shown in FIG. 1 taken along the line 5—5 and looking in the direction of the arrows.
Figure 6:
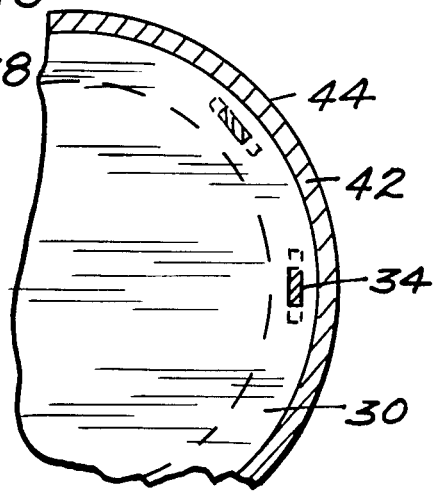
FIG. 6 is a fragmentary view taken along the line 6—6 in FIG. 5 and looking in the direction of the arrows.

With reference now to the drawings, wherein like reference characters designate like or corresponding parts throughout the several views, there is shown in FIGS. 1-6 a tamper-proof container 10 having a bottom wall 12 and a sidewall 14 defining an outer surface 16 and projecting upwardly from bottom wall 12 to form an upper edge 18.

A first annular ring member 20 integral with upper edge 18 defines an open mouth area 22 of container 10. First ring member 20 further defines an upper flat annular surface 24 contiguous with open mouth 22, and ring member 20 further defines a lower annular surface 26. A plurality of openings 28 each extend between upper annular surface 24 and lower annular surface 26.

A thin tearable sheet member 30, preferably metal foil, or plastic is located across open mouth area 22 and is positioned onto upper annular surface 24. Sheet member 30 is preferably glued to upper annular surface 24. A second annular ring member 32 defines a plurality of barb-shaped prongs 34, and second ring member 32 is positioned against sheet member 30 and on upper annular surface 24 with prongs 34 projecting through sheet member 30 and through openings 28 with the barbed portions of prongs 34 grippingly engaging lower annular surface 26.

Means 36 are provided in operative relationship with sidewall 14 for removably capping open mouth area 22 of the container. Typically, capping means 36 may include threads 38 formed into sidewall 14 and a conventional threaded cover 40 designed to threadedly engage threads 38.

In accordance with the invention, second ring member 32 is substantially L-shaped in cross section (FIG. 5) and includes a flange 42 projecting downwardly and adjacent to outer surface 16 from a position adjacent to upper annular surface 24. Each of prongs 34 are of predetermined length for enabling the barbed portions of prongs 34 to tightly engage lower annular surface 26 whereby second ring member 32 is tightly held against sheet member 30.

In order to enhance visual detection of any tampering with container 10, flange 42 defines an outer surface 44 having a repetitive design or lettering thereon whereby cutting of flange 42 or attempts at cutting the flange would visually disfigure the design or lettering to show that tampering with the container had occurred. Similarly, sheet member 30 preferably defines a repetitive design or lettering thereon whereby any tearing or puncturing of sheet member 30 will be visible to show that tampering with the container has occurred.

Ring member 32 and prongs 34 may be made of plastic material or metal. Alternatively, ring member 32 may be made of plastic and prongs 34 may be made of metal to be made more resistant to tampering and cutting.

It is preferable that prongs 34 be of a predetermined length to require machine application of ring member 32 to enable the barbed portions of the prongs to grab and engage lower annular surface 26. Prongs 34 will puncture sheet member 30 during application of ring member 32 to the container, and openings 28 may be preformed within ring member 20 to receive prongs 34. If prongs 34 are comprised of metal the prongs themselves may form openings 28 as ring member 32 is being applied to the container.

The embodiment of the invention illustrated in FIGS. 1–6 provides for a highly tamper-resistant container. Any puncturing or tearing of sheet member 30 will be clearly visible. The thickness and strength of flange 42 also will discourage the use of razor blades or the like in attempts to cut through flange 42 to reach and sever prongs 34. The use of repetitive designs or lettering on sheet member 30 and on outer surface 44 of flange 42 will enhance visible detection of any cutting or puncturing, and any tampering with sheet member 30 or with surface 44 will cause irreparable visible material damage.

Figure 9:
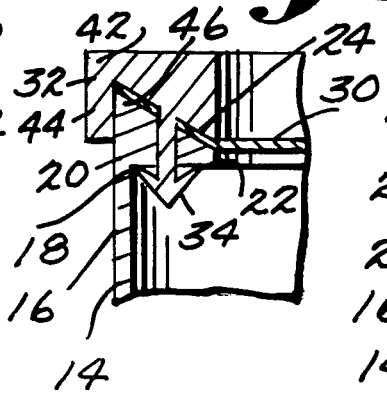
FIG. 9 is a fragmentary cross section of a portion of an alternative embodiment.

An alternative embodiment of container 10 is illustrated in FIG. 9 wherein upper flat annular surface 24' is slanted downwardly and inwardly from outer surface 16 toward open mouth area 22 to form an acute angle 46 with outer surface 16. The configuration of the invention embodiment illustrated in FIG. 9 discourages entry of razor blades or the like from the inner diameter of ring member 32 in attempting to cut prongs 34.

Figure 10:
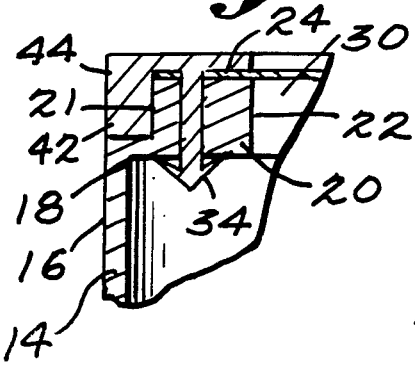
FIG. 10 is a fragmentary cross section of a portion of another alternative embodiment.

Another embodiment of the invention is illustrated in FIG. 10 wherein first ring member 20 defines a notch 21 around the exterior perimeter of ring member 20, and notch 21 is of a size and configuration to receive flange 42. The use of notch 21 provides for a smooth and continuous surface between outer surface 16 and outer surface 44 and makes it more difficult to tamper with flange 42.

Figure 11:
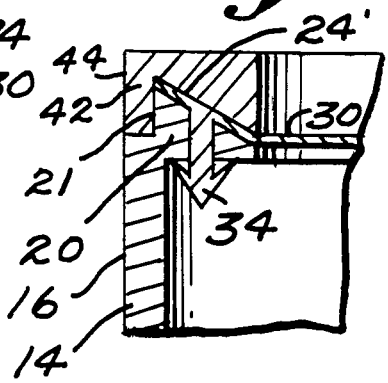
FIG. 11 is a fragmentary cross section of a portion of still another alternative embodiment.

Another embodiment of the invention is illustrated in FIG. 11 wherein upper flat annular surface 24' is slanted and where notch 21 is provided in ring member 20 around the exterior perimeter of ring member 20 and wherein notch 21 is of a size and configuration to receive flange 42 whereby outer surface 16 meets and is substantially continuous with outer surface 44.

Figure 7:
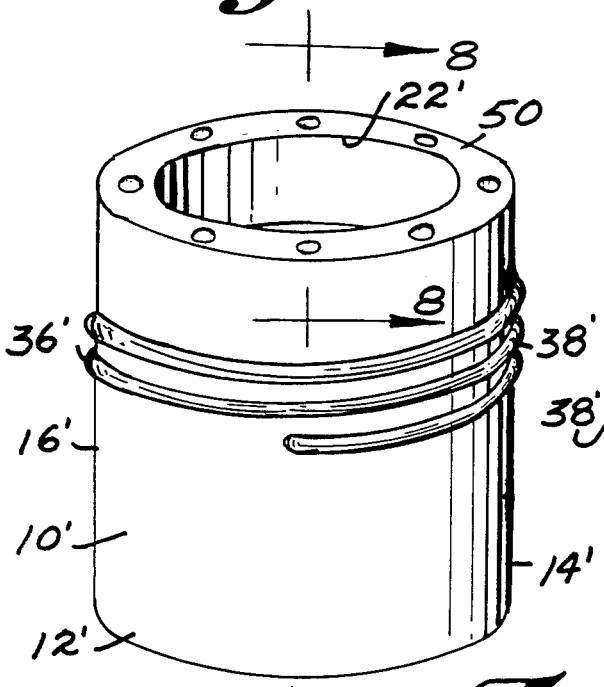
FIG. 7 is a perspective view of another tamper-proof container embodiment without the cap and without second annular ring member in position.
Figure 8:
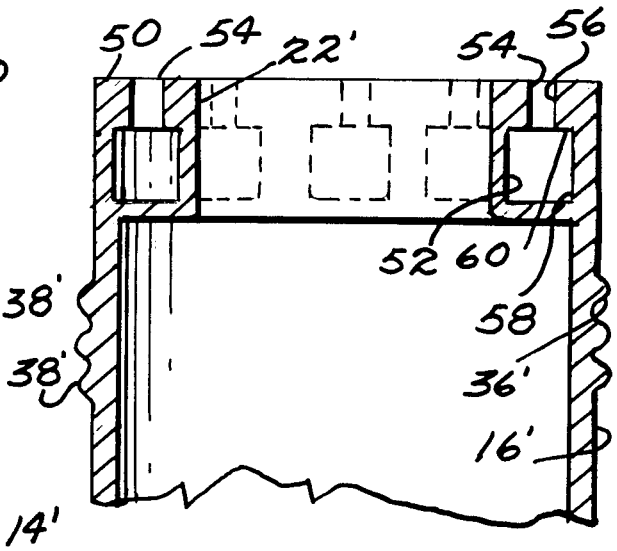
FIG. 8 is a fragmentary cross-sectional view taken along the line 8—8 in FIG. 7 and looking in the direction of the arrows.

Another embodiment of the invention is partially illustrated in FIGS. 7 and 8 wherein tamper-proof container 10' includes a bottom wall 12' and a sidewall 14' defining an outer surface 16'. Sidewall 14' projects upwardly from bottom wall 12' to form an open mouth area 22' and to form an upper flat annular edge surface 50 contiguous with open mouth area 22'. Sidewall 14' further defines a plurality of spaces 52 therein, and edge surface 50 defines a plurality of openings 54 therein. Each of openings 54 is in fluid communication with a respective one of spaces 52.

Each of spaces 52 is shaped to provide for a first substantially cylindrically shaped upper space portion 56 and a second substantially cylindrically shaped lower space portion 58 joined in fluid communication with each other. Each lower space portion 58 has a diameter greater than the diameter of each upper space portion 56, and a shoulder 60 is defined at the junction of upper space portion 56 with lower space portion 58.

A thin, tearable, sheet member (not shown), such as the metal foil previously described, is located across open mouth area 22' and is glued into position onto upper flat annular edge surface 50. An annular ring member 32 (FIG. 3) is provided which defines a plurality of barb-shaped prongs 34. Ring member 32 is positioned against the tearable sheet member and onto upper flat annular edge surface 50 with prongs puncturing and projecting through the sheet, through openings 54, through upper space portions 56 and into lower space portions 58. Each of prongs 34 is provided with a barbed portion which grippingly engages shoulders 60 to hold ring member 32 tightly against the sheet member.

Means 36' are provided in operative relationship with sidewall 14' for removably capping open mouth area 22'. As in the previously described embodiments, capping means 36' may include threads 38' on outer surface 14' and a threaded cap or cover, such as cap 40 in FIG. 1, for threadedly engaging threads 38'.

In the embodiment illustrated in FIGS. 7 and 8, prongs 34 (FIG. 3) are each of predetermined length for enabling the prongs to tightly hold ring member 32 against the sheet member by means of the barbed portions of prong members 34 grippingly engaging shoulders 60.

Figure 12:
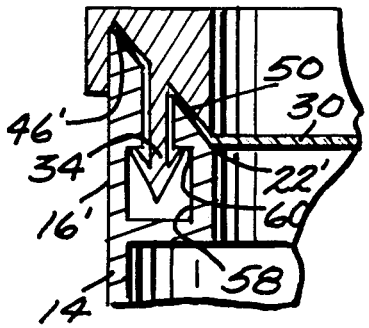
FIG. 12 is a fragmentary cross section of a portion of another alternative embodiment.

Another embodiment of the invention is illustrated in FIG. 12 wherein upper flat annular edge surface 50 is slanted downwardly and inwardly from outer surface 16' toward open mouth area 22' to form an acute angle 46' with outer surface 16'.

Figure 13:
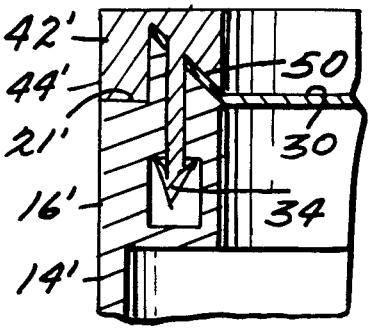
FIG. 13 is a fragmentary cross section of a portion of a further alternative embodiment.

As illustrated in FIG. 13, another embodiment of the invention provides a notch 21' defined within sidewall 14'; and notch 21' is adjacent to slanted upper flat annular edge 50 and extends around the exterior perimeter of sidewall 14'. Notch 21' is of a size and configuration to receive flange 42' whereby outer surface 44' substantially meets with and is continuous with outer surface 16'.

Figure 14:
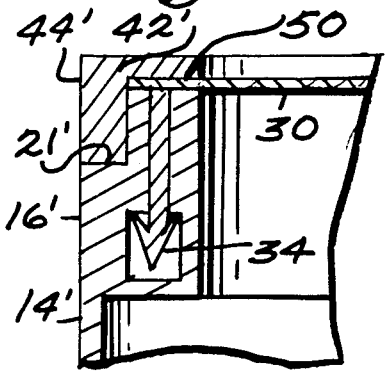
FIG. 14 is a fragmentary cross section of a portion of another alternative embodiment.

Another embodiment of the invention is illustrated in FIG. 14 wherein upper annular surface 50 is not slanted and wherein sidewall 14' defines a notch 21' adjacent to upper flat annular edge 50. Notch 21' extends around the exterior perimeter of sidewall 14'; and notch 21' is of a size and configuration to receive flange 42' so that outer surface 44' meets and is substantially continuous with outer surface 16'.

Each of the embodiments described provides for a tamper-proof container in which tampering causes irreparable visible material damage to the container. If the container is tampered with the fact that tampering has occurred will be clearly apparent.

The invention in its broader aspects is not limited to the specific details shown and described, and departures may be made from such details without departing from the principles of the invention and without sacrificing its chief advantages.

What is claimed is:

1. A tamper-proof container, comprising:

a bottom wall;

at least one sidewall defining an outer surface and projecting upwardly from said bottom wall to form an upper edge;

a first annular ring member integral with said upper edge of said sidewall and defining an open mouth area of said container, said first ring member further defining an upper flat annular surface contiguous with said open mouth area, a lower annular surface and a plurality of openings extending between said upper and said lower annular surfaces;

a thin tearable sheet member located across said open mouth area and positioned onto said upper annular surface;

a second annular ring member defining a plurality of barb-shaped prongs, said second ring member positioned against said sheet on said upper annular surface with said prongs projecting through said sheet and said openings to grippingly engage said lower annular surface; and means in operative relationship with said sidewall for removably capping said open mouth area.

2. A container as in claim 1 wherein said sheet member is glued to said upper annular surface.

3. A container as in claim 2 wherein said second ring member is substantially L-shaped in cross-section.

4. A container as in claim 3 wherein said second ring member includes a flange projecting downwardly and adjacent to said sidewall outer surface from a position adjacent to said upper annular surface.

5. A container as in claim 4 wherein said prongs are each of predetermined length for enabling said prongs to tightly hold said second ring member against said sheet member by said prong barbs engaging said lower annular surface.

6. A.container as in claim 5 wherein said flange defines an outer surface having a repetitive design or lettering thereon whereby cutting said flange or attempts at cutting said flange would visually disfigure said design or lettering to show that tampering with said container had occurred.

7. A container as in claim 6 wherein said sheet member is comprised of metal foil or plastic.

8. A container as in claim 6 wherein said sheet member has a repetitive design or lettering thereon whereby any tearing or puncturing of said sheet member will be visible to show that tampering with said container has occurred.

9. A container as in claim 5 wherein said prongs are comprised of metal.

10. A container as in claim 5 wherein said upper flat annular surface is slanted downwardly and inwardly from said outer surface toward said open mouth area to form an acute angle with said outer surface of said sidewall.

11. A container as in claim 10 wherein said first ring member defines a notch around the exterior perimeter of said first ring member, said notch of a size and configuration to receive said flange.

12. A container as in claim 5 wherein said first ring member defines a notch around the exterior perimeter of said first ring member, said notch of a size and configuration to receive said flange.

13. A tamper-proof container, comprising:

a bottom wall;

at least one sidewall defining an outer surface and projecting upwardly from said bottom wall to form an open mouth area and an upper flat annular edge surface, contiguous with said open mouth area:

said sidewall further defining a plurality of spaces therein;

said upper flat annular edge surface defining a plurality of openings therein, each of said openings in fluid communication with a respective one of said spaces;

each of said spaces shaped to provide a first substantially cylindrically shaped upper space portion and a second substantially cylindrically shaped lower space portion joined in fluid communication with said upper space portion, said lower space portion having a diameter greater than the diameter of said upper space portion, and a shoulder defined at the junction of said upper and lower space portions;

a thin, tearable sheet member located across said open mouth area and positioned onto said upper flat annular edge surface;

an annular ring member defining a plurality of barb-shaped prongs, said ring member positioned against said sheet on said upper flat annular edge surface with said prongs projecting through said sheet, through said openings, through said upper space portions and into said lower space portions, each of said prong barbs grippingly engaging one of said shoulders to hold said ring member tightly against said sheet member; and means in operative relationship with said sidewall for removably capping said open mouth area.

14. A container as in claim 13 wherein said sheet member is glued to said upper annular edge surface.

15. A container as in claim 14 wherein said ring member is substantially L-shaped in cross-section.

16. A container as in claim 15 wherein said ring member includes a flange projecting downwardly and adjacent to said sidewall outer surface from a position adjacent to said upper annular edge surface.

17. A container as in claim 16 wherein said prongs are each of predetermined length for enabling said prongs to tightly hold said ring member against said sheet member by said prong barbs engaging said shoulders.

18. A container as in claim 17 wherein said prongs are comprised of metal.

19. A container as in claim 17 wherein said upper flat annular edge surface is slanted downwardly and inwardly from said outer surface toward said open mouth area to form an acute angle with said outer surface.

20. A container as in claim 19 wherein said sidewall further defines a notch adjacent to said upper flat annular edge and extending around the exterior perimeter of said sidewall and said edge, said notch of a size and configuration to receive said flange.

21. A container as in claim 17 wherein said sidewall further defines a notch adjacent to said upper flat annular edge and extending around the exterior perimeter of said sidewall and said edge, said notch of a size and configuration to receive said flange.

* * * * *